United States Patent [19]

Marugg

[11] 4,333,729

[45] Jun. 8, 1982

[54] APPARATUS FOR HOMOGENIZING LIQUID AND VISCOUS SUBSTANCES

[76] Inventor: Max H. Marugg, Zizers, Switzerland

[21] Appl. No.: 15,952

[22] PCT Filed: Jun. 26, 1978

[86] PCT No.: PCT/EP78/00002

§ 371 Date: Feb. 28, 1979

§ 102(e) Date: Feb. 28, 1979

[87] PCT Pub. No.: WO79/00020

PCT Pub. Date: Jan. 25, 1979

[30] Foreign Application Priority Data

Jul. 1, 1977 [DE] Fed. Rep. of Germany ..... 2729855

[51] Int. Cl.[3] ..... F04B 39/12; F04B 39/14

[52] U.S. Cl. ..... 417/313; 417/454; 366/267; 366/337

[58] Field of Search ..... 417/454, 539, 568, 313; 366/336, 337, 339; 99/452

[56] References Cited

U.S. PATENT DOCUMENTS

| | | | |
|---|---|---|---|
| 1,550,882 | 8/1925 | Colony | 366/268 |
| 2,397,281 | 3/1946 | Mac Ewing | 366/267 |
| 3,125,963 | 3/1964 | Whitley et al. | 417/454 |
| 3,185,103 | 5/1965 | Yohpe | 417/454 |
| 3,253,882 | 5/1966 | Deackoff | 99/452 |
| 3,427,002 | 2/1969 | Wilding | 366/336 |
| 3,941,355 | 3/1976 | Simpson | 366/336 |
| 4,035,110 | 7/1977 | Plasko | 417/454 |
| 4,053,141 | 10/1977 | Gossefold | 366/336 |
| 4,074,363 | 2/1978 | Croff | 366/339 |
| 4,135,829 | 1/1979 | Grillo | 366/337 |
| 4,140,442 | 2/1979 | Mulvey | 417/454 |
| 4,168,018 | 9/1979 | Zahaykeurch | 366/339 |

FOREIGN PATENT DOCUMENTS

| | | | |
|---|---|---|---|
| 611333 | 12/1960 | Canada | 417/568 |

*Primary Examiner*—William L. Freeh
*Attorney, Agent, or Firm*—Jerry Cohen

[57] ABSTRACT

The subject of the invention is an apparatus for homogenizing liquid and viscous substances, which consists of a high-pressure pump with a crank drive and at least one piston guided in a cylinder block and driven by means of connecting and side rods, and a homogenizing unit, which is arranged on the cylinder block of the high-pressure pump by means of an intermediary chamber that may be opened. The homogenizing unit has a two-part homogenizing head, which consists of a sleeve with a smooth-walled, conical let-through borehole opening out on the outlet side and a plunger held in this borehole by axial compression and guided by guide projections into the corresponding recesses arranged in the sleeve, which plunger has a solid section of essentially truncated-cone-shaped surface area, on which axial and successive ring-shaped steps are constructed, each step having its external periphery adjacent to the borehole.

14 Claims, 6 Drawing Figures

APPARATUS FOR HOMOGENIZING LIQUID AND VISCOUS SUBSTANCES

TECHNICAL FIELD

The invention concerns an apparatus for homogenizing liquid and viscous substances, consisting of a high-pressure pump with a crank drive and at least one piston driven by means of connecting rods and side rods, guided in a cylinder block, connected to a homogenizing device placed on the cylinder block, which device has a homogenizing head that consists of a sleeve with a smooth, conical let-through borehole opening out on the outlet side and a plunger held in this borehole by means of axial compression; this plunger consists of a solid section with an essentially truncated-cone-shaped surface, on which axial and successive steps are built, each of which steps are placed with their outer periphery toward the borehole.

THE BASIC STATE OF THE ART

In known homogenizing devices of this type, the high-pressure pump is constructed as a piston pump, the piston of which is driven by a crank drive with a flanged motor by means of connecting and side rods. The homogenizing device properly speaking, i.e., the homogenizing head with the plunger, is placed directly on the cylinder block.

In such homogenizing devices, the liquid to be homogenized is aspirated into the cylinder through the inlet by reverse drive of the piston, and is pressed out from the cylinder by the homogenizing head during the compression process. Such devices may operate with or without inlet and outlet valves and, in addition, several pistons may operate in parallel on the homogenizing head.

It is a disadvantage in these known homogenizing devices that there is an unsteady operation due to the parallel operation of the pistons. In order to avoid this disadvantage, a method is known for nonparallel operation of the pistons, by allowing them to operate in staggered fashion according to number. In order to draw up such a design without valves, each cylinder must have its own homogenizing head.

In fact, this arrangement offers the advantage of a steadier and more uniform operation of the piston pump; however, the flow of the liquid through the homogenizing unit is discontinuous.

A continuous passage through the homogenizing head is of advantage for a good liquid dispersion. This continuous operation can be obtained in the case of a multi-cylinder design with at least two cylinders operating on a single homogenizing head, by providing this unit with valves both at the inlet and outlet sides of the cylinder head.

Such homogenizing devices operating with valves have the basic disadvantage that they can be easily stopped up, the valves frequently leak, and, in particular, it is very difficult to clean the cylinder head equipped with outlet valves, and the plunger in the homogenizing head, upon continuous impact through the dispersing liquid, no longer contacts the throat in the sleeve and is no longer centered or is displaced somewhat in the borehole.

Another criticism of the design of homogenizing devices is the formation of the plunger contained in the homogenizing head. It is known that the plunger is designed with sequential axial steps in such a way that they have the form of a rectangle in the profile contained in the solid longitudinal axis of the plunger. Consequently, the steps contact the spherical borehole via truncated-cone-shaped ring surfaces, the size of which depends on the respective height of the individual steps. Recesses of uniform height are provided between the steps; the substance to be homogenized is spun out after passing through one step and can then be mixed again. All of the steps are of uniform height and therefore take up the same quantity of substance before it passes to the next step. Since the substance to be homogenized must pass through flat spaces pressed tightly against each other, only a limited degree of pulverization of particles can be obtained; in addition, in those cases when the substance has a pulpy or viscous consistency, a very high pressure is required and only a very low throughput is obtained. In some cases, when a particle, which is somewhat more resistant than the other particles, gets in between the surfaces, the remaining particles can pass undispersed through the spaces in the homogenizing head, until this more resistant particle is pulverized.

In order to avoid the disadvantages inherent in such step surfaces, a known improvement is to reduce the step surfaces to cup points. However, a disadvantage in this method is that no larger recesses are provided between the individual cup points into which the substance to be homogenized can be mixed again after being cut up, before it is homogenized by the following cup point. A further disadvantage in this known device is that the sharp-edged cup points wear out very quickly under a high pressure load and extreme vibrations of the plunger due to occasional irregular impacts against the smooth let-through borehole, since a displacement of the plunger occurs here also, due to lack of contact with the borehole.

The aim of the invention is to design an apparatus of the given type such that the existing disadvantages, named above, are eliminated and so that a homogenizing unit is created which has a better dispersion and at the same time has a better efficiency. It further aims at providing a better dispersing capacity at lower pressure so that the substance to be homogenized is handled more carefully, for example, undergoing only a slight heating. Also the substance should not only be finely dispersed, but better blended. Such objectives will apply also to thick or viscous substances; in this case the homogenizing device will also be less susceptible to blocking up and to valve leaks; finally, accessibility to the valves and the homogenizing head will be facilitated.

DISCLOSURE OF THE INVENTION

The above objectives are solved according to the invention on the basis of an apparatus of the known type by placing an intermediary chamber, which may be opened, between the homogenizing unit and the cylinder block of the high-pressure pump.

The design of the homogenizing device according to the invention allows this device to be loaded with a substance compressed by more than one pressure cylinder in a non-parallel operation of the pistons and in this way, an essentially more continuous speed is assured. In addition, since the intermediary chamber can be opened, it is easy to clean both the homogenizing head and the outlet valves.

In another advantageous embodiment, the intermediary chamber consists of a first chamber section built on the front side of the cylindrical block and a second chamber section holding the homogenizing device connected in detachable fashion to the front chamber section.

The separation of the two chamber sections is advantageously effected by a plane perpendicular to the axis of the cylinder[s] arranged parallel-axially in the cylinder block, and the homogenizing device is advantageously built onto a wall of the second chamber section parallel to the parting line, such that the longitudinal axis of the plunger is parallel to the cylinders' axes. In addition, in the preferential embodiment, the second chamber section is held to the first chamber section by a hinge with the hinge axis parallel to the parting line. In this way, the opening of the intermediary chamber is essentially facilitated; it may be opened without disengaging the movable chamber section.

In another advantageous embodiment, an outlet valve incorporated between the compression chamber of the respective cylinder and the intermediary chamber can be detached when the second chamber section is open. This assures the rapid cleaning of the outlet valve, freeing it from the highly compressed material which has flowed through it, or makes it easy for this outlet valve to be changed without the necessity for a major mounting or demounting of the homogenizing device.

In another preferential embodiment, four segmented recesses are made in a valve plate contained in the valve, made from a circular base plate of external diameter $d_a$, corresponding to the maximal internal diameter of the valve, at an angle distance of $\alpha=30°$ each in the outer edge of the base plate; these recesses encompass an angle of 60°, whereby the internal diameter $d_i$ contacting these circular recesses is greater than the diameter of the inlet opening and bridges remain between these recesses. This design of the valve plate particularly assures a tight closing and therefore no valve leaking when viscous substances are processed.

In a further embodiment according to the invention, the high-pressure pump formed with horizontal cylinders is joined by a trough to the crankcase holding the crankshaft drive and the leakproof-constructed guidebars; the trough holds the guidebars with the side rods joined to the pistons; and ring-shaped collars are placed on the side rods.

By placing a trough between the guidebars and the cylinder block of the high-pressure pump, the oil which is contained in the crankcase is kept from mixing with the substance to be homogenized and possibly falling out of the cylinders. By placing collars on the side rods, it is possible to set up the homogenizing device horizontally, since the collars prevent the oil from running down the side rods. The possibility of a horizontal arrangement of the homogenizing device also brings about a facilitated operation of the intermediary chamber section with the homogenizing device and therefore, the valves are more accessible.

In another advantageous embodiment, the cylinder block is provided with boreholes which may be filled with fluid to heat or cool the cylinders.

The cylinder block of the high-pressure pump can be heated or cooled with a specific liquid, depending on the substance to be homogenized or relative to the consistency of the substance to be homogenized.

In a further embodiment according to the invention, the objectives are solved by providing each step of the plunger with two sides meeting in a cup point, these sides being arranged in a triangular shape contained in the horizontal axis of the solid [plunger] section; the bisecting line of the latter which passes through the vertex contacting the borehole lies essentially in a radial plane of the solid section.

In the design according to the invention, by keeping the smooth, conical, and thus easily manufactured borehole, the contacting surface between the borehole and the plunger pressed with axial stress is kept to a minimum. The steps of the plunger form linear cup points with the borehole, and the substance to be homogenized is shred between these points.

In another embodiment of the invention, the vertex angle $\gamma$, which is enclosed by the two sides forming the cup point of each step, amounts to 60°. It is preferable that the axial distance of the radial planes passing through the cup points of sequential steps alternate in size; this distance is first equal to the length of the triangular side opposite the vertex and is then equal to double this value.

In another embodiment according to the invention, ring-shaped recesses are formed in the solid section between the steps of larger axial distance, and these recesses preferably each have the form of a triangle in a profile contained in the longitudinal axis of the solid piece, whereby the sides of the recesses extend into the sides of the two adjacent steps.

These further embodiments according to the invention offer the advantage that the ring-shaped recesses between the cup points make possible a blending of the substance to be homogenized after each cutting process. Since the distances between these steps alternate in size, both large and small recesses are produced, in which the substance is further blended in different amounts each time.

Since the recesses are also triangular in section, the plunger can be easily manufactured.

In another advantageous embodiment, the plunger has a total of seven steps, each with a cup point; two steps of small axial distance are provided at the outlet end, and also at the outlet end, next to the cup points, there are at least three centering "noses" projecting over the periphery of the cup points, these projections being passed into recesses with cylindrical surface area, whic are provided in the borehole of the sleeve.

This design according to the invention offers the advantage that the plunger is centered even when its cup points do not contact the borehole and in this way, the gaps between the individual cup points the borehole, distributed constantly over the circumference, have the same distance. This arrangement prevents the plunger with its cup points from hitting the borehole on just one side during the plunger impaction through the liquid to be homogenized, and thus prevents the sharp-edged cup points from wearing out very rapidly and unevenly, or from becoming distorted.

In another embodiment according to the invention, the distance between the cup points placed at the inlet and the outlet ends is essentially the same as the diameter of the last cup point; the taper of the throat is in the range of 1:0.15–1:0.05, and the diameter of the cup point at the outlet end is 5 centimeters.

This advantageous embodiment assures that the plunger is not pressed out too far from the conical borehole by the compressed substance, a problem which would cause the substance to be less well homogenized. The design also in this way makes possible a higher efficiency for the unit.

A non-limiting example of embodiment is shown in the drawings and described in more detail as follows:

BEST EMBODIMENT OF THE INVENTION

Figure 1:
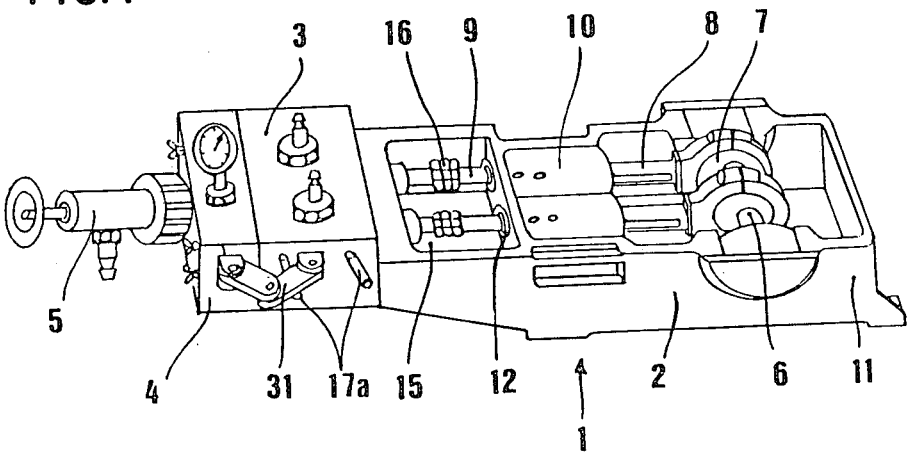
FIG. 1 is a perspective view of the apparatus for homogenizing with a homogenizing device, the intermediary chamber with manometer, the cylinder block with the inlet valves and the crankshaft drive with side rods and guide rods cut away.

The example of embodiment given in FIG. 1 shows the homogenizing apparatus 1, which basically consists of drive block 2, high-pressure pump 3, intermediary chamber 4, and homogenizing unit 5.

Homogenizing apparatus 1 operates in a horizontal arrangement and is driven by a motor (not shown) by means of a crankshaft 6. In this embodiment example, two connecting rods 8 are driven by crankshaft 6 by means of eccentric disks 7. The upper ends of connecting rods 8 are attached in movable fashion to side rods 9 and laid in guide bars 10. Side rods 9 project from guide bars 10 and are made tight with side rod gaskets 12 opposite crankcase 11 filled with oil.

Figure 2:
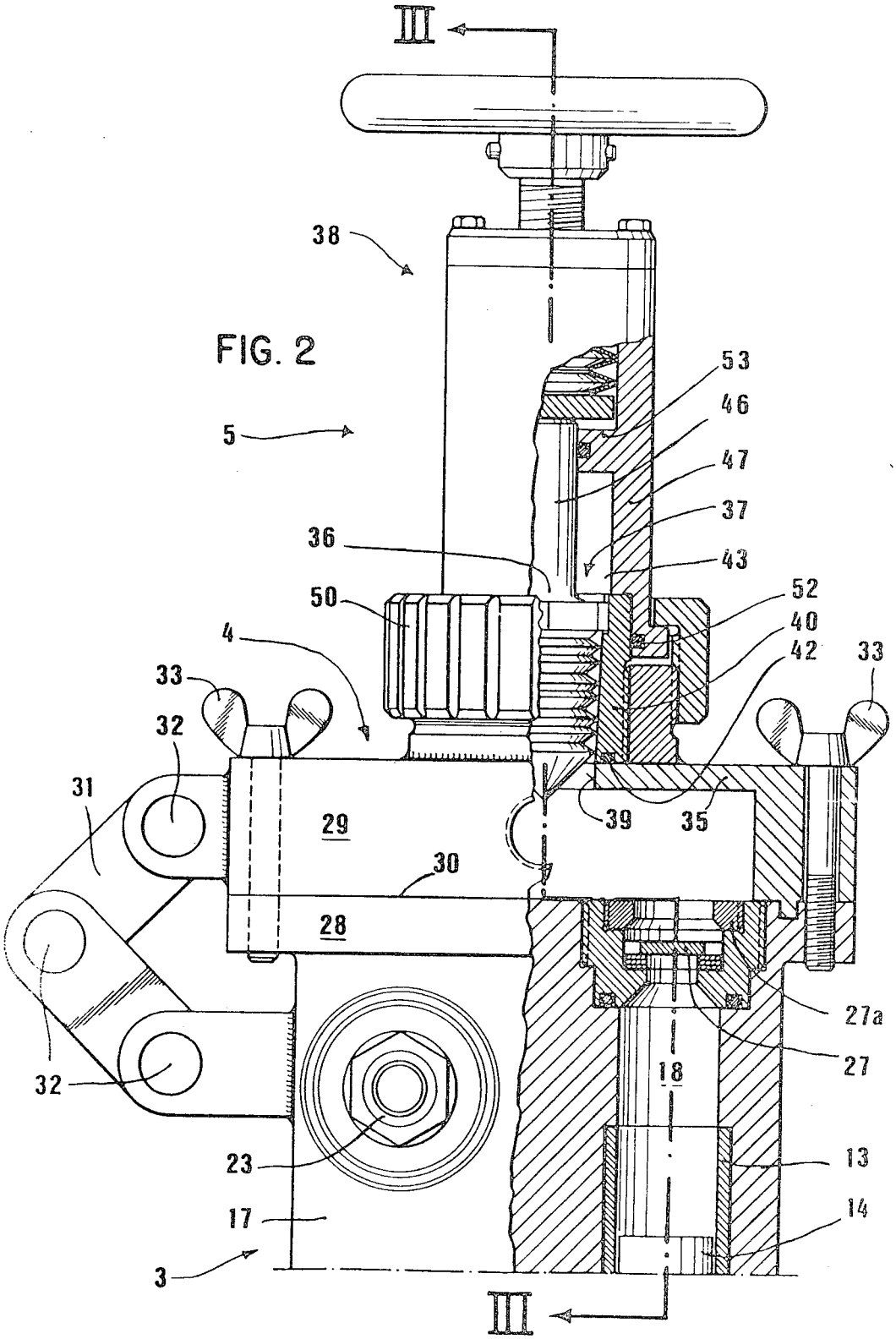
FIG. 2 is a partially cut-away top view of the homogenizing device, the intermediary chamber, and the cylinder block.
Figure 3:
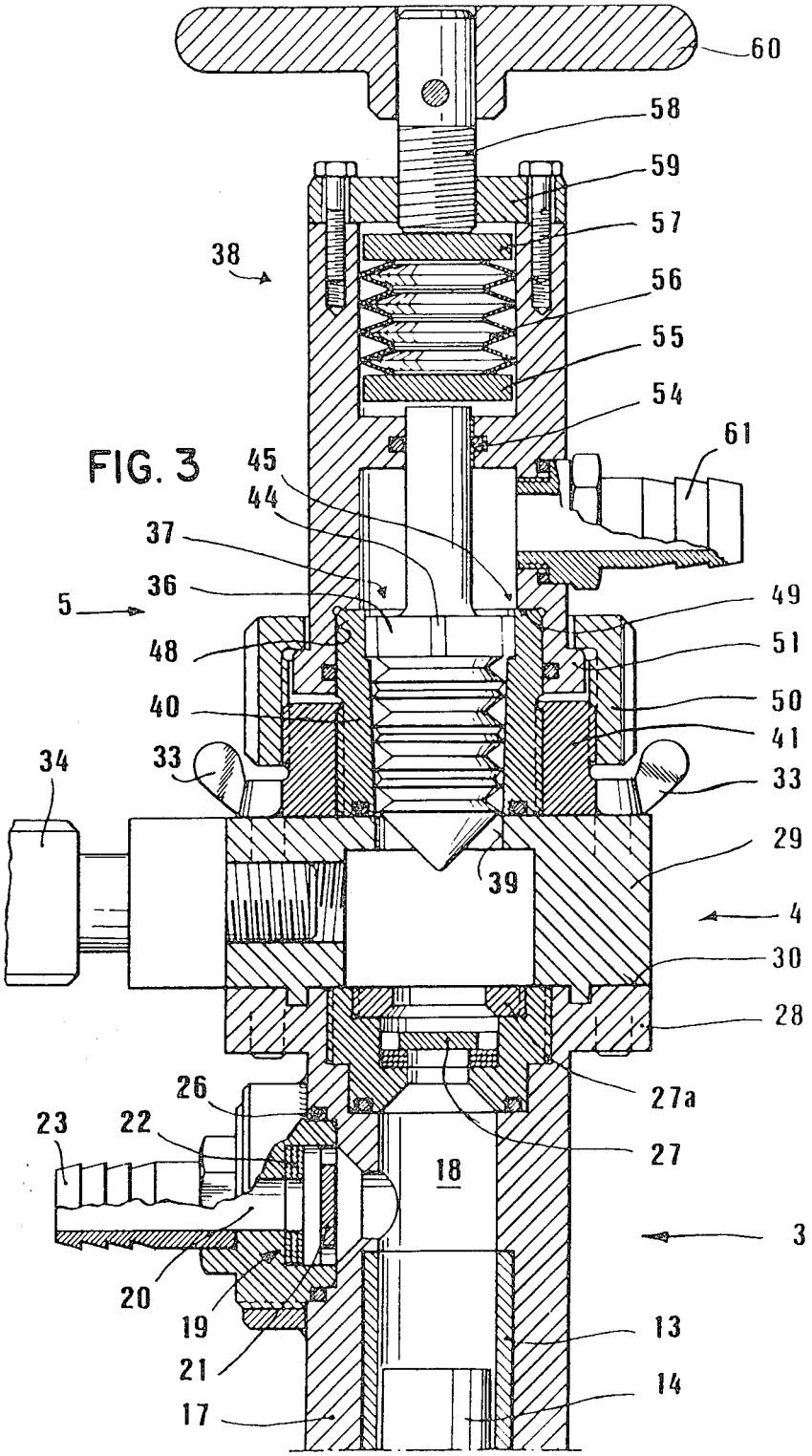
FIG. 3 is a section along line III—III in FIG. 2.

Side rods 9 convey the stroke motions of connecting rods 8 onto pistons 14 which can be moved in sleeves 13 (shown in FIGS. 2 and 3). Before entering sleeves 13, side rods 9 span a trough 15, which will hold any oil possibly spilling from crankcase 11. In this way, any oil that may spill and flow along the rods will not be able to penetrate the sleeve during the stroke motions of these rods; collars 16 are placed on side rods 9, which collars cause a spinning off of the oil caused by the motion of side rods 9. On the other hand, by the intermediate placement of trough 15 and the collars 16 arrangement, it is assured that the substance to be homogenized cannot penetrate crankcase 11.

Borings 17*a* are provided in cylinder blocks 3; these boreholes can be filled with fluids which either heat or cool the cylinders, depending on the requirements.

FIGS. 2 and 3 show the high-pressure pump 3, intermediary chamber 4, and homogenizing unit 5.

The end of piston 14 depicted in FIGS. 2 and 3 passes through a sleeve 13, preferably made of bronze, which sleeve is placed in cylinder block 17 of high-pressure pump 3. Compression space 18 is enclosed at the end of sleeve 13, into which space passes inlet opening 20 provided with an inlet valve 19, this opening being perpendicular to the axis of piston 14 or of compression space 18. Inlet valve 19 contains a valve plate 21, which presses against gasket rings 22 when the pressure is increased in compression space 18, and closes inlet opening 20. A conduit supplying the substance to be homogenized is joined at the inlet connection 23.

Figure 6:
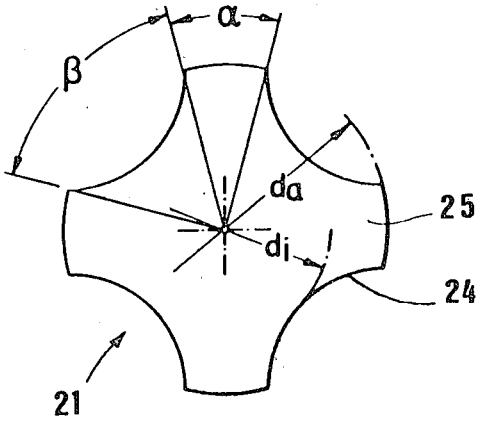
FIG. 6 is a view of a valve plate.

FIG. 6 shows valve plate 21. Starting with a circular baseplate of external diameter $d_a$, which corresponds to the maximal internal diameter of valve 19, recesses 24, in the form of circular segments, are arranged at angular distances of $\alpha=30°$ each in the outer edge of the base plate; these recesses encompass an angle of $\beta=60°$. The internal diameter $d_i$ contacting these circular-shaped recesses 24, is thus larger than the diameter of inlet opening 20. Bridges 25 remain between recesses 24. Valve plate 21 is pressed against gasket rings 22 when the compressive pressure increases in compression space 18, and closes the inlet opening 20. In an open position, the substance to be homogenized is permitted to enter compression space 18 through inlet opening 20 and circular recesses 24 between bridges 25 in valve plate 21. The entire valve 19 is constructed with inlet connection 23 in such a way that it can be unscrewed and rests against cylinder block 17 with gasket 26 in between.

An outlet valve 27 is placed on an axial extension of compression space 18. This outlet valve 27 corresponds in structure to valve 19, also having a valve plate and gasket rings. It is also held tight against cylinder block 17 by means of gaskets 26 and may be unscrewed after a nut 27*a* has been removed.

Intermediary chamber 4 is connected to cylinder block 17 of high-pressure pump 3. Intermediary chamber 4 forms the connection between the individual compression spaces 18 or cylinders and homogenizing unit 5. Therefore, outlet valve 27 can be easily and rapidly changed. Intermediate chamber 4 is constructed in two sections, the first section 28 attached to high-pressure pump 3, and the second chamber section 29, which may be detached from the first section, holding homogenizing unit 5. Parting line 30 of the two chamber sections 28 and 29 is placed in a plane perpendicular to the axes of the cylinders parallelly set in cylinder block 17; the second chamber section 29 is attached to the first chamber section 28 by hinge 31 with hinge axes 32 parallel to the parting line 30, so that the second chamber section 29 can be swung out like a door from the first chamber section 28 after removing thumb screws 33. Hinge 31 is constructed such that the second chamber section 29 can be removed to provide access to outlet valves 27, and so that there is enough free space to unscrew these valves and also to clean the intermediary chamber.

Intermediary chamber 4 is connected to a special manometer 34, which provides a reading of the pressure in this chamber.

The homogenizing unit is attached to a wall 35 of the second chamber section 29 parallel to the parting line in such a way that the longitudinal axis of plunger 36 is parallel to the axes of the cylinders.

Homogenizing unit 5 essentially consists of a two-part homogenizing head 37 and a hand-actuated compression unit 38. Sleeve 40 of the two-part homogenizing head 37 is attached to the outlet opening 39 provided in wall 35 of the second chamber section 29 of intermediary chamber 4. Sleeve 40 is screwed into a flange 41 with a screw thread, and pressed against wall 35 of the second chamber section 29 of intermediary chamber 4 with a gasket 42 placed in between. Sleeve 40 of homogenizing head 37 has a smooth, conical borehole 43 opening out to the outlet side, and a plunger 36 of homogenizing head 37 is pressed into this borehole, said plunger provided with axially and successively arranged steps 63. This plunger 36 is guided into recesses 45 with cylindrical surface area 45*a*, which are placed in sleeve 40, by means of 4 centering projections 44, which are placed next to steps 63 at the outlet end and which project beyond the periphery of these steps 63. In addition, plunger 36 with its shaft 46 is placed in the outlet direction in a housing 47 and can be displaced longitudinally. Housing 47 has on its lower end an enlarged borehole 48 and contacts with radial flange 49 sleeve 40 of the two-part homogenizing head 37. A screw cap 50 is screwed onto the external thread of flange 41 and holds housing 47 next to a bead-shaped projection 51. A gasket 52 is placed between sleeve 40 of the two-part homogenizing head 37 and the bead projection 51 of the housing.

Shaft 46 of plunger 36 is placed in housing 47 in a ring-shaped bridge 53 by means of a gasket 54. A lower pressure plate 55 is found on the end of shaft 46 above ring-shaped bridge 53. Above pressure plate 55 is found a cup spring 56, the top of which connects in turn to an upper pressure plate 57. A spindle 58 is screwed on through housing plate 59 against this upper pressure plate 57; this spindle can be controlled by means of hand wheel 60 in such a way that cup spring 56 is more or less compressed and in this way the internal plunger 36 of the two-part homogenizing head 37 is pressed to the same extent in the conical borehole 43 of sleeve 40. An outlet connection 51 is provided above the two-part homogenizing head 37.

Figure 4:
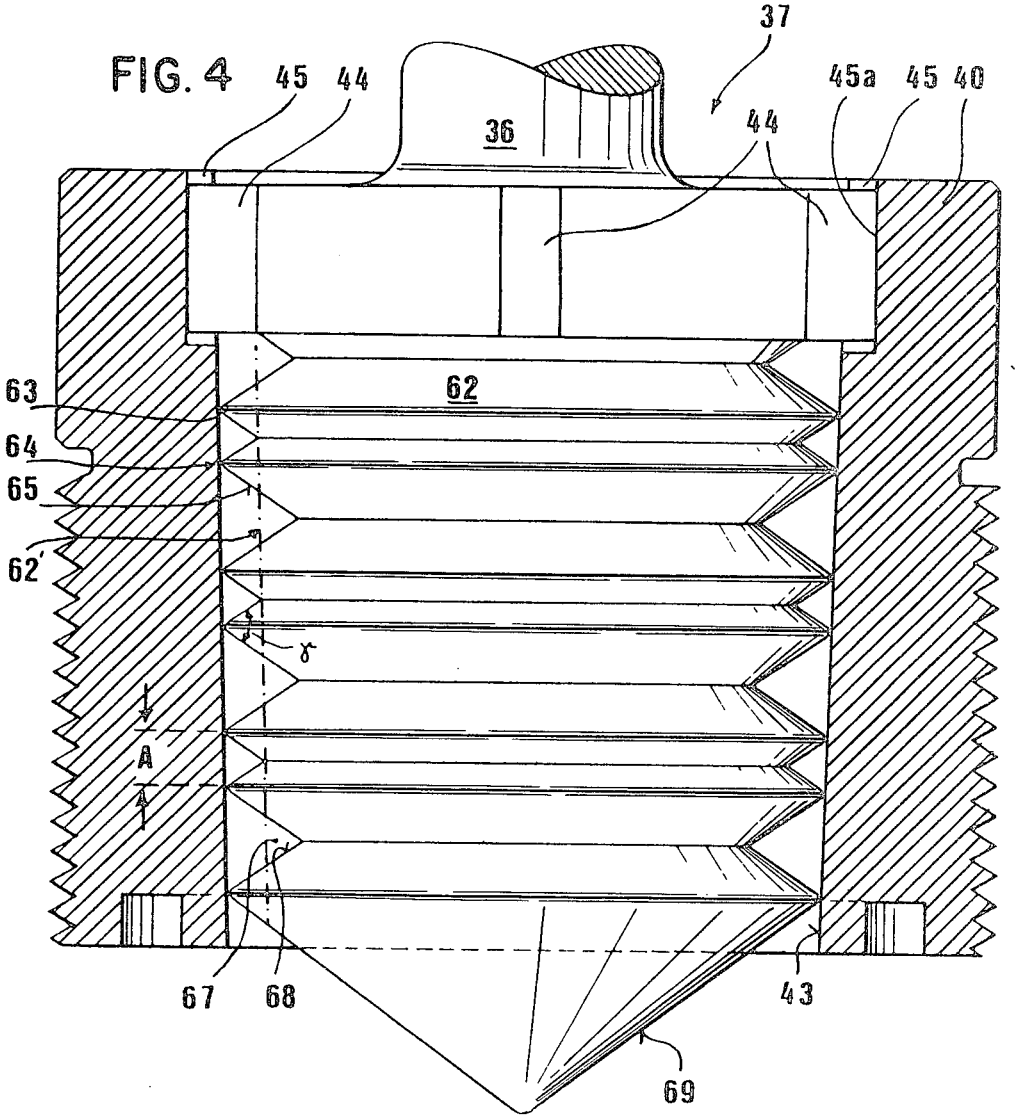
FIG. 4 is a section shown through the homogenizing head with conical borehole and plunger.
Figure 5:
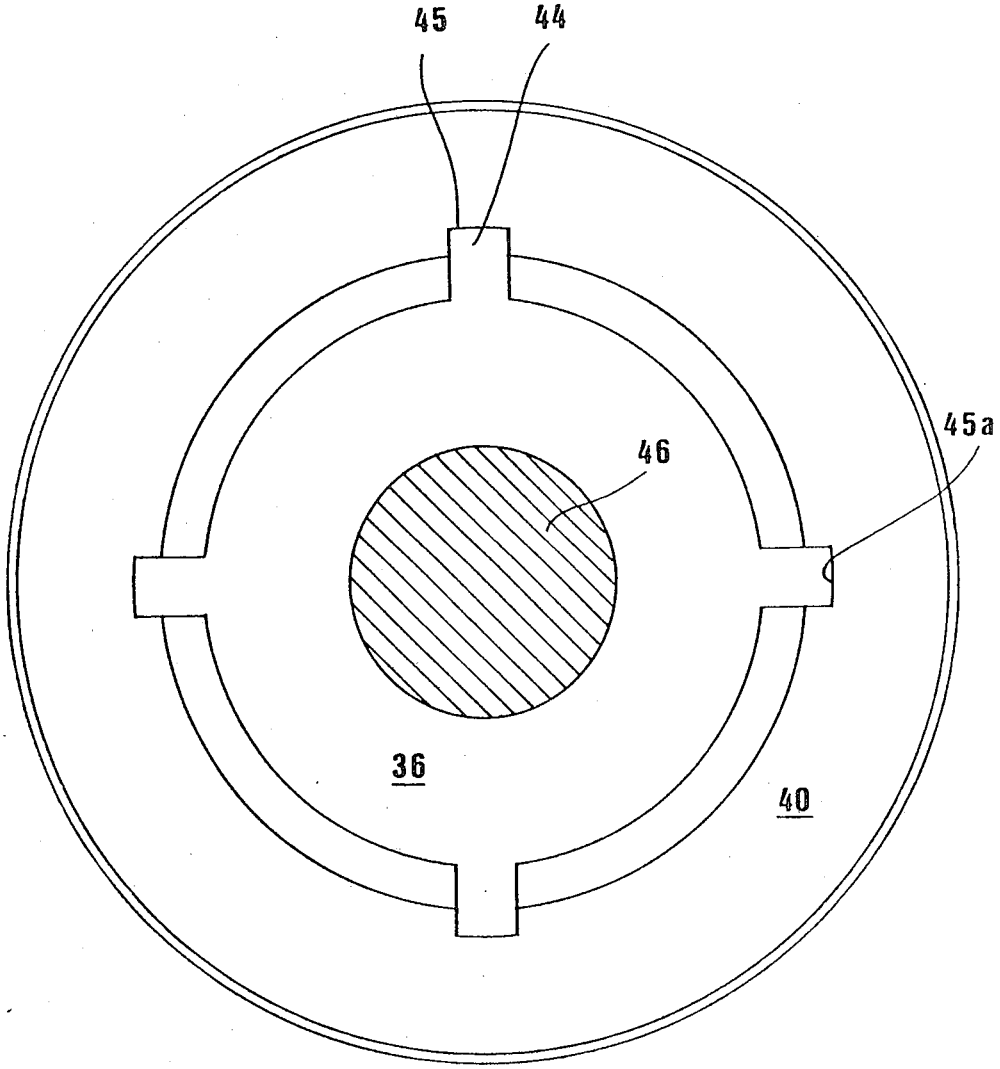
FIG. 5 is an overview of the homogenizing head from the outlet side.

The two-part homogenizing head 37 is shown in FIG. 4. Plunger 36 of homogenizing head 37 has steps 63 arranged axially and successively on its solid section 62 of basically truncated-cone-shaped surface area 62'; these steps have a triangular shape in a cross section contained in the longitudinal axis of the solid section, and lie against the wall of conical borehole 43 of sleeve 40, their sides 65 forming a cup point 54 each time. The bisecting line proceeding through the vertex of the angle $\gamma$ of approx. 60° enclosed between those of sides 62 essentially lies in a radial plane of solid section 62.

The axial distance A of the radial planes proceeding through the cup points 64 of successive steps 63 is first equal to the length of the triangular side lying opposite the vertex, and in every second step, this value is equal to double the first value. Ring-shaped recesses 67 are formed between steps 63 having the larger axial distance in solid section 62 of plunger 36; each of these recesses has the form of a triangle on its profile contained in the longitudinal axis of the solid section [62], whereupon sides 68 of the recesses extend into sides 65 of steps 63 lying on both sides.

Plunger 36 of homogenizing head 37 has a total of seven steps 63, each having a cup point 64, in which two steps equal to the smaller distance are arranged next to the outlet end.

The distance of the cup points placed first on the inlet and outlet end is essentially the same as the diameter of the cup point arranged at the outlet end. The diameter of this cup points amounts to 5 centimeters, while the taper of borehole 43 is in the range of 1:0.15 –1:0.05.

Plunger 36 is lastly provided with an obtuse-angle cone 69 at its inlet end.

INDUSTRIAL APPLICATION

The presently described embodiment of the device according to the invention may be applied to the manufacture of foodstuffs, such as margarine, mayonnaise, milk products, doughs, all types of sauces, mustard, etc., as well as in the production of emulsions, creams, pastes, and salves for cosmetics, medicines, and chemical-technical products. Such an homogenizing device is particularly suited for application in the manufacture of coloring agents [dyes, paints, inks]. In the past, coloring agents could be ground down only on roll frames in the manufacturing process, necessitating a great deal of time. However, it is now possible to disperse such viscous substances with the homogenizing device described above. It is also possible to repeat this homogenizing process and in this way there results the advantage that the coloring agent is altered slightly in shade after treatment. It is essential that each individual dispersion process will save time when compared with the rubbing process on conventional roll frames.

Homogenizing or dispersing liquid or viscous substance can be illustrated as follows:

The substance to be homogenized is drawn up into compression space 18 through inlet valve 19 and inlet connection 23 by pulling back piston 14. As soon as piston 14 is moved again after passage through the dead space in back, the pressure is increased in compression space 18 and inlet valve 19 closes. At the same time, outlet valve 27 opens and the substance found in compression space 18 is compressed and squeezed into intermediate chamber 4. Plunger 36 of the two-part homogenizing head 37 guided by its centering projections 44 in recesses 45 of sleeve 40 is minimally pressed upward opposite the stress coming from cup spring 56, so that the compressed substance can penetrate between cup points 64 of plunger 36 and the smooth wall of borehole 43 of sleeve 40. In this way the substance is separated between cup points 64 and the wall of borehole 43, cut up, and at the same time spun intensely into the recesses 67 of different size between cup points 64 and is homogenized again by subsequent cup points 64. After passing through the homogenizing head, the substance can be removed from outlet connection 61.

I claim:

1. Homogenizing apparatus for liquid and pulpy substances, consisting of a high-pressure pump with a crank drive and at least one piston arranged in a cylinder block, driven by means of connecting and side rods, and connected to a homogenizing device placed on a cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump and further characterized in that the high-pressure pump/formed with horizontal cylinders is joined by means of a trough to the crankshaft drive and crankcase holding leak-proof guidebars, that trough holds guidebar with side rods joined to piston, and that ring-shaped collars are arranged on side rods.

2. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump and further characterized in that the intermediate chamber consists of a first chamber section constructed on the front side of the cylinder block and a second chamber section holding homogenizing unit joined to the first section in a detachable manner and further characterized in that the separating wall of the two chamber sections is arranged in a plane perpendicular to axis or axes of the cylinder or cylinders, which are in turn arranged parallel-axially in the cylinder block, and that homogenizing unit is attached to a wall of the second chamber section parallel to the separating plane in such a way that the longitudinal axis of plunger is parallel to the axis or axes of the cylinder or cylinders and further characterized in that the second chamber section is attached to the first chamber section by a hinge with the hinge axes parallel to the separating plane.

3. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump and further characterized in that the intermediate chamber consists of a first chamber section constructed on the front side of the cylinder block and a second chamber section holding homogenizing unit joined to the first section in a detachable manner and further characterized in that the separating wall of the two chamber sections is arranged in a plane perpendicular to axis or axes of the cylinder or cylinders, which are in turn arranged parallel-axially in the cylinder block, and that homogenizing unit is attached to a wall of the second chamber section parallel to the separating plane in such a way that the longitudinal axis of plunger is parallel to the axis or axes of the cylinder or cylinders and further characterized in that a detachable outlet valve incorporated between compression space of the respective cylinder and intermediate chamber is found in the opened second chamber section.

4. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump, and further characterized in that cylinder block is provided with boreholes which can be filled with a liquid that can heat or cool the cylinder.

5. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump and further characterized in that the intermediate chamber consists of a first chamber section constructed on the front side of the cylinder block and a second chamber section holding homogenizing unit joined to the first section in a detachable manner and further characterized in that the second chamber section is attached to the first chamber section by a hinge with the hinge axes parallel to the separating plane.

6. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump, and further characterized in that for said plunger held by axial compression each step has two sides ending in a cup point and these sides are arranged in the form of a triangle in a profile contained in the longitudinal axis of the solid section; the bisecting line of the triangle passing through the vertex adjacent to the borehole lies essentially in a radial plane of the solid section.

7. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump and further characterized in that the intermediate chamber consists of a first chamber section constructed on the front side of the cylinder block and a second chamber section holding homogenizing unit joined to the first section in a detachable manner and further characterized in that a detachable outlet valve incorporated between compression space of the respective cylinder and intermediate chamber is found in the opened second chamber section.

8. Apparatus according to claim 7 further characterized in that four segmented recesses are arranged in a valve plate contained in the valves, which plate is of spherical form with an outer diameter $d_a$, which corresponds to the maximal internal diameter of the valve, each of these segments found at an angle distance of $\alpha = 30°$ in the outer edge of the base plate; these recesses encompass an angle of 60°, whereby the internal diameter $d_i$ contacting these spherical recesses is larger than the diameter of inlet opening and bridges remain between recesses.

9. Homogenizing apparatus for liquid and pulpy substances, consisting of a high-pressure pump with a crank drive and at least one piston arranged in a cylinder block, driven by means of connecting and side rods, and connected to a homogenizing device placed on the cylinder block, which device has a homogenizing head that consists of a sleeve with a smooth spherical bore up on the outlet side and a plunger held by axial compression arranged in this borehole, which plunger consists of a solid section of essentially truncated cone-shaped surface area, onto which axial and successive step rings are built, each of which steps are placed with their outer periphery toward the borehole, is characterized by the fact that an intermediate chamber, which may be opened, is placed between homogenizing unit and cylinder head of the high-pressure pump.

10. Apparatus according to claim 9 is further characterized in that the intermediate chamber consists of a first chamber section constructed on the front side of the cylinder block and a second chamber section holding homogenizing unit joined to the first section in a detachable manner.

11. Apparatus according to claim 10 is further characterized in that the separating wall of the two chamber sections is arranged in a plane perpendicular to axis or axes of the cylinder or cylinders, which are in turn arranged parallel-axially in the cylinder block, and that homogenizing unit is attached to a wall of the second chamber section parallel to the separating plane in such a way that the longitudinal axis of plunger is parallel to the axis or axes of the cylinder or cylinders.

12. Apparatus according to claim 11 is further characterized in that the distance between the cup points associated with the inlet and the outlet ends is basically identical to the diameter of the last cup point.

13. Apparatus according to claim 12 is further characterized in that the taper of borehole lies in the range of 1:0.15–1:0.05.

14. Apparatus according to claim 13 is further characterized in that the diameter of cup point found at the outlet end amounts to 5 cm.

* * * * *